US007005038B2

(12) United States Patent
Maguire

(10) Patent No.: US 7,005,038 B2
(45) Date of Patent: Feb. 28, 2006

(54) BELT-MACHINE COMBINATION

(75) Inventor: Michael Maguire, Way Cross, GA (US)

(73) Assignee: National Wire Fabric, Inc., Star City, AK (US)

( * ) Notice: Subject to any disclaimer, the term of this patent is extended or adjusted under 35 U.S.C. 154(b) by 314 days.

(21) Appl. No.: 10/263,774

(22) Filed: Oct. 4, 2002

(65) Prior Publication Data

US 2003/0066570 A1 Apr. 10, 2003

Related U.S. Application Data

(60) Provisional application No. 60/327,000, filed on Oct. 5, 2001.

(51) Int. Cl.

| | |
|---|---|
| ***D21F 1/12*** | (2006.01) |
| ***D21F 1/14*** | (2006.01) |
| ***D03D 3/04*** | (2006.01) |

(52) U.S. Cl. ..... 162/348; 162/903; 162/904; 139/383 AA; 139/425 A; 245/10; 28/142; 442/187

(58) Field of Classification Search ..... 162/116, 162/117, 306, 348, 358.2, 900–904, 361, 162/362; 139/383 A, 425 A, 383 AA; 245/10; 428/57–59; 28/110, 142; 442/187, 301
See application file for complete search history.

(56) References Cited

U.S. PATENT DOCUMENTS

| | | | | | |
|---|---|---|---|---|---|
| 1,440,159 | A | * | 12/1922 | Lindsay | 245/10 |
| 1,593,668 | A | * | 7/1926 | O'Neill | 139/425 A |
| 1,747,276 | A | * | 2/1930 | Webb | 245/10 |
| 1,949,593 | A | * | 3/1934 | Weissenborn et al. | 245/10 |
| 2,241,668 | A | | 5/1941 | Martin | |
| 3,060,547 | A | * | 10/1962 | MacBean | 28/141 |
| 3,238,594 | A | * | 3/1966 | Schuster | 28/141 |
| 3,366,355 | A | * | 1/1968 | Haller | 245/10 |
| 3,425,900 | A | * | 2/1969 | Purdy | 162/348 |
| 3,622,415 | A | * | 11/1971 | Kunsman | 156/158 |
| 3,700,194 | A | * | 10/1972 | MacBean | 245/10 |
| 3,784,133 | A | * | 1/1974 | Hill et al. | 245/10 |
| 3,900,659 | A | * | 8/1975 | MacBean | 428/223 |
| 4,083,090 | A | * | 4/1978 | Duvekot | 28/104 |
| 4,095,622 | A | * | 6/1978 | MacBean | 139/383 AA |
| 4,182,381 | A | * | 1/1980 | Gisbourne | 139/383 AA |
| 4,311,172 | A | * | 1/1982 | Eckstein | 139/383 AA |
| 4,410,015 | A | * | 10/1983 | Koller et al. | 139/383 AA |
| 5,366,778 | A | * | 11/1994 | Johnson | 428/58 |
| 6,378,566 | B1 | | 4/2002 | Kornett | |
| 6,722,394 | B1 | * | 4/2004 | Harrison et al. | 139/383 R |

* cited by examiner

*Primary Examiner*—Eric Hug
(74) *Attorney, Agent, or Firm*—Pillsbury Winthrop Shaw Pittman

(57) ABSTRACT

A paper process belt and method for manufacturing the same are provided. The belt includes at least one elongated resilient coupling filament operatively connected to a first end section of the belt and a second end section of the belt such that the first end section, the second end section and a body portion of the belt are substantially continuous with one another. The belt is configured to operatively engage a paper manufacturing machine.

18 Claims, 7 Drawing Sheets

BELT-MACHINE COMBINATION

This application is related to U.S. Provisional Patent Application No. 60/327,000, "Improved Belt-Machine Combination," Maguire, filed Oct. 5, 2001, the contents of which are incorporated herein by reference in their entirety.

FIELD OF THE INVENTION

The field of the invention relates to a process belt used in the manufacture of corrugated paper stock, for example, by combining liner board and corrugated material.

BACKGROUND INFORMATION

Generally, process belts are used in the preparation of pulp or materials in sheet or non-woven fabric, such as paper, in the Paper Making Industry. Such process belts are typically woven wire fabric formed into continuous or endless belts by brazing or welding. For example, end sections of such process belts are generally brazed or welded together to form a brazed or welded seam between the end sections of the process belt, thereby introducing a local stiffness at the seam.

However, brazing or welding typically degrades the strength and malleability of the wires adjacent the brazed or welded seam due to elevated temperatures. The degradation can result in premature failure of such process belts at or near the brazed or welded seam, which results in the process belt being removed, repaired and reinstalled or replaced with a new process belt.

BRIEF DESCRIPTION OF THE DRAWINGS

The accompanying drawings, which are incorporated in and constitute a part of the specification, of embodiments of the invention, together with the general description given above and the detailed description of the embodiments given below, serve to explain the principles of the invention wherein.

DESCRIPTION OF EMBODIMENTS OF INVENTION

Figure 1:
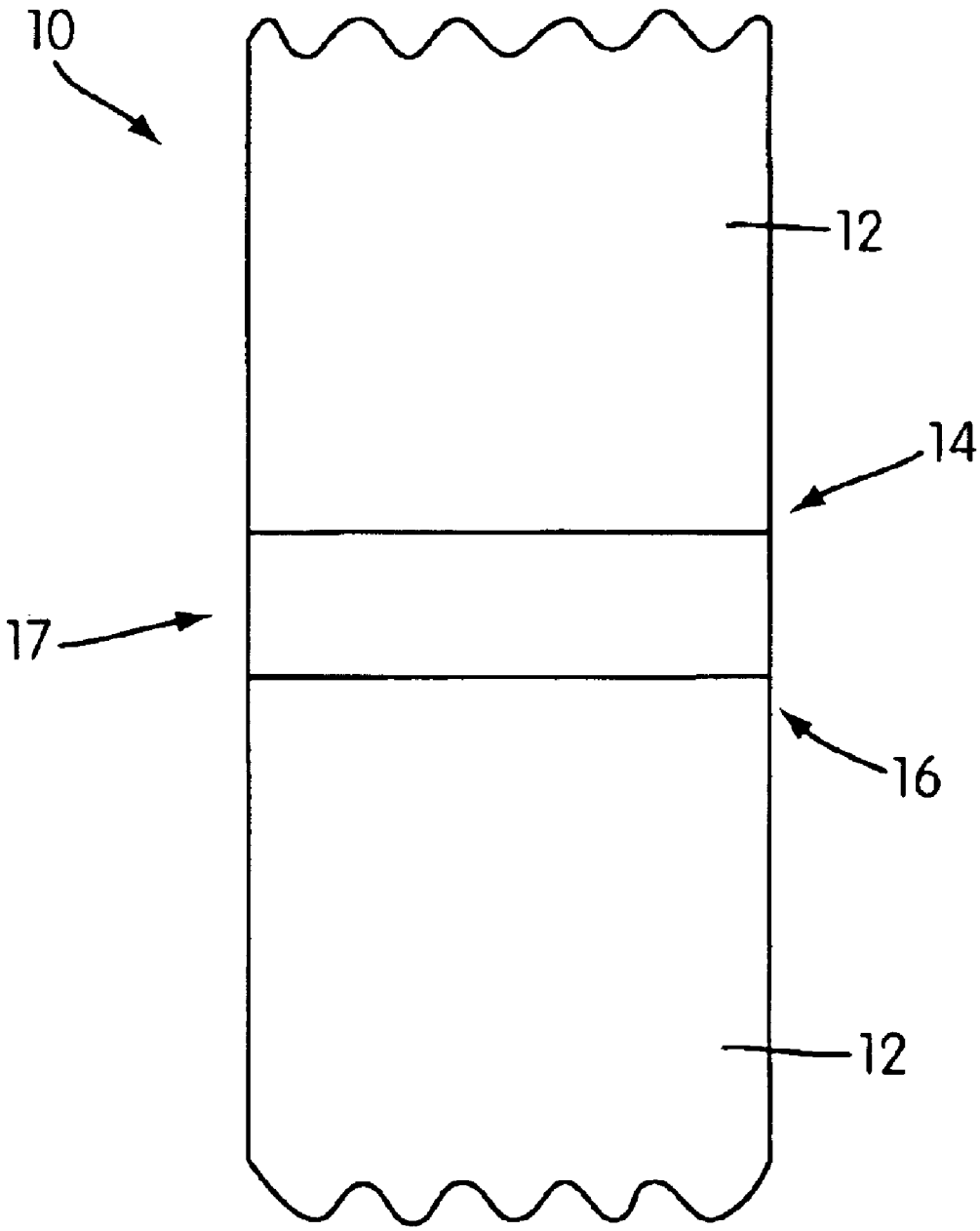
FIG. 1 is a view of a process belt in accordance with principles of the invention.
Figure 3:
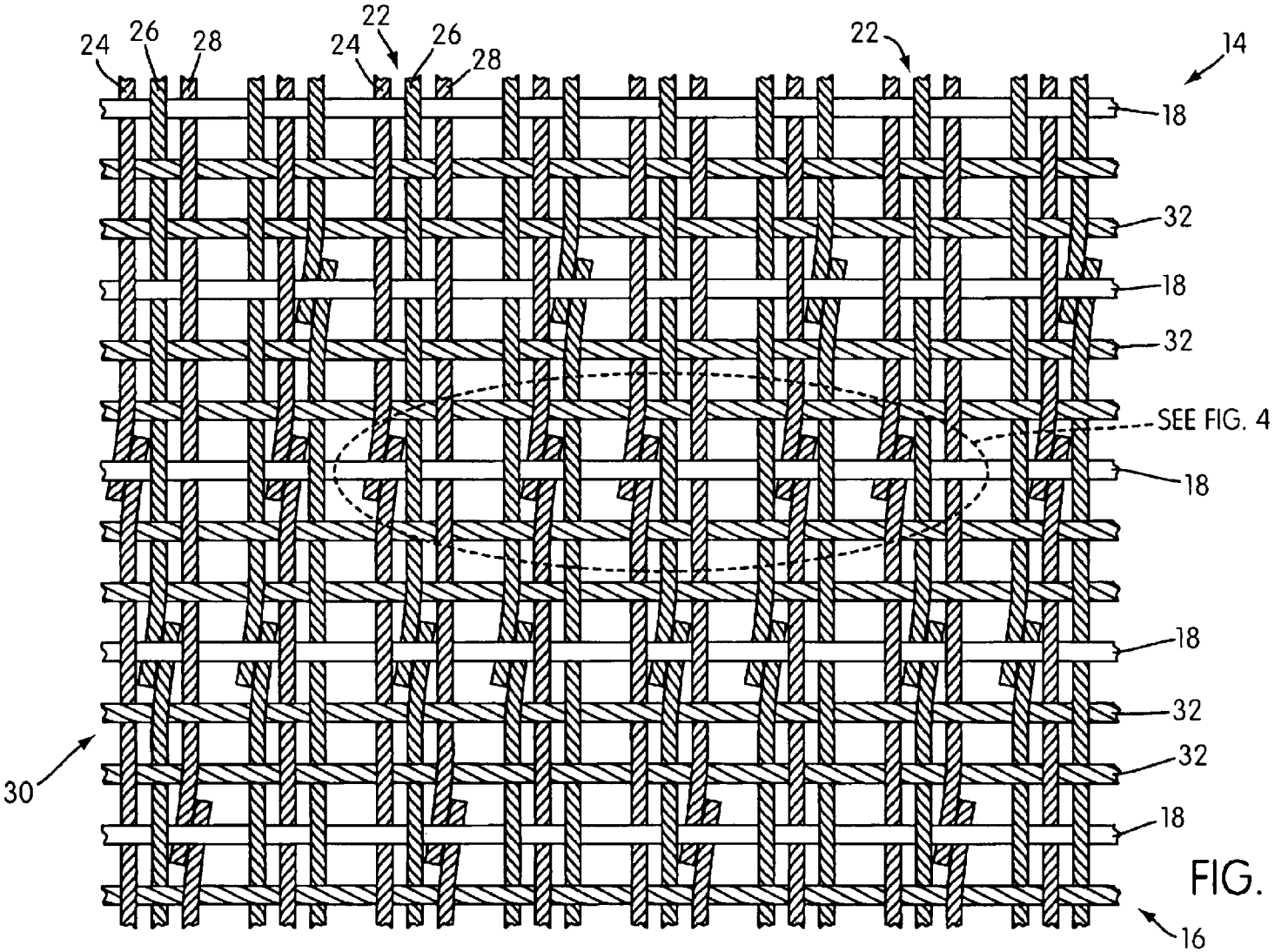
FIG. 3 is a top view of the process belt shown in FIG. 1.
Figure 4:
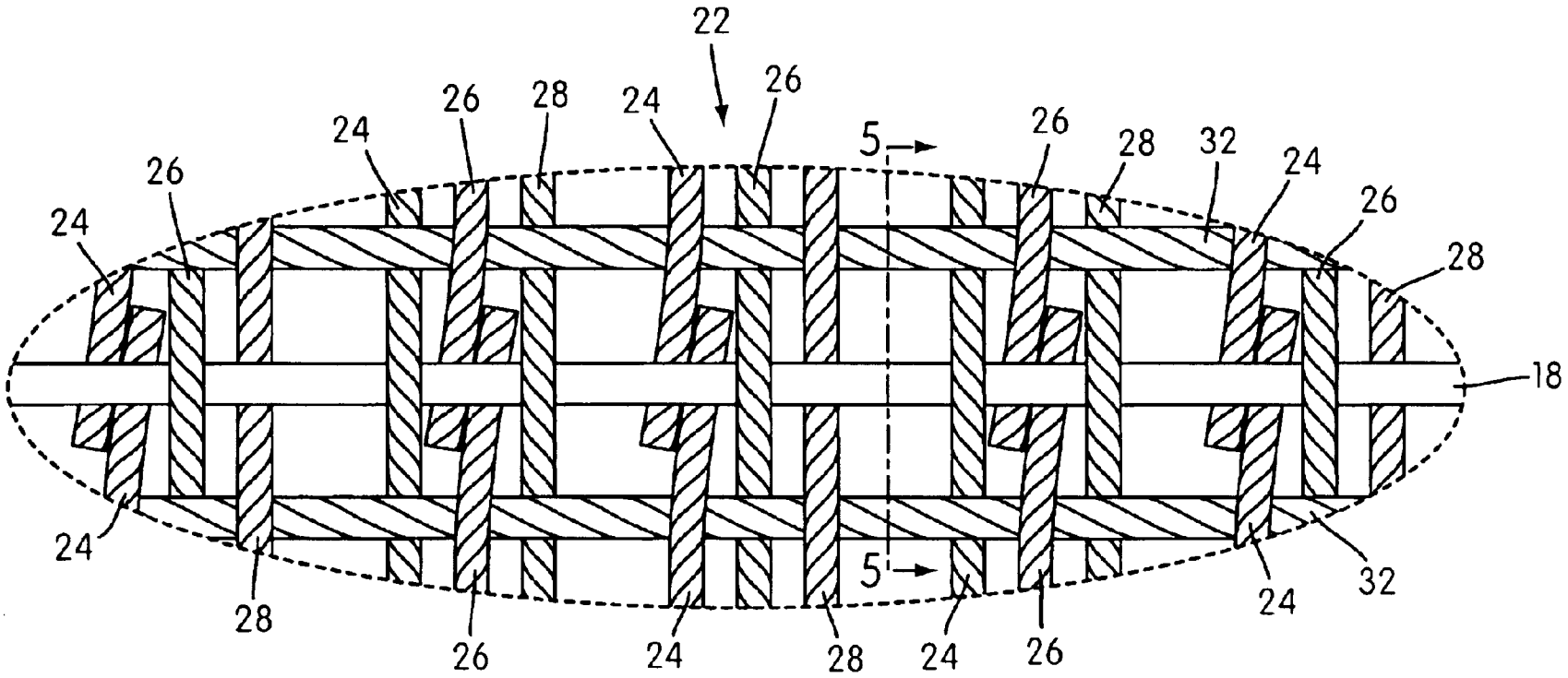
FIG. 4 is a view showing an enlarged section 4—4 of FIG. 3.

FIG. 1 shows an embodiment of a paper process belt, generally indicated at 10, for use in a paper manufacturing machine to process a paper stock. The paper process belt 10 comprises a body portion, generally indicated at 12, separating a first end section 14 and a second end section 16. The body portion 12 is only partially shown in FIG. 1. The first end section 14 is operatively coupled to the second end section 16 by a woven seam, generally indicated at 17, such that the body portion 12, the first end section 14 and the second end section 16 are substantially continuous with one another and configured to operatively engage the paper manufacturing machine, as is further described below. The woven seam 17 can include at least one elongated resilient coupling filament 18 (FIGS. 3–4).

Figure 2:
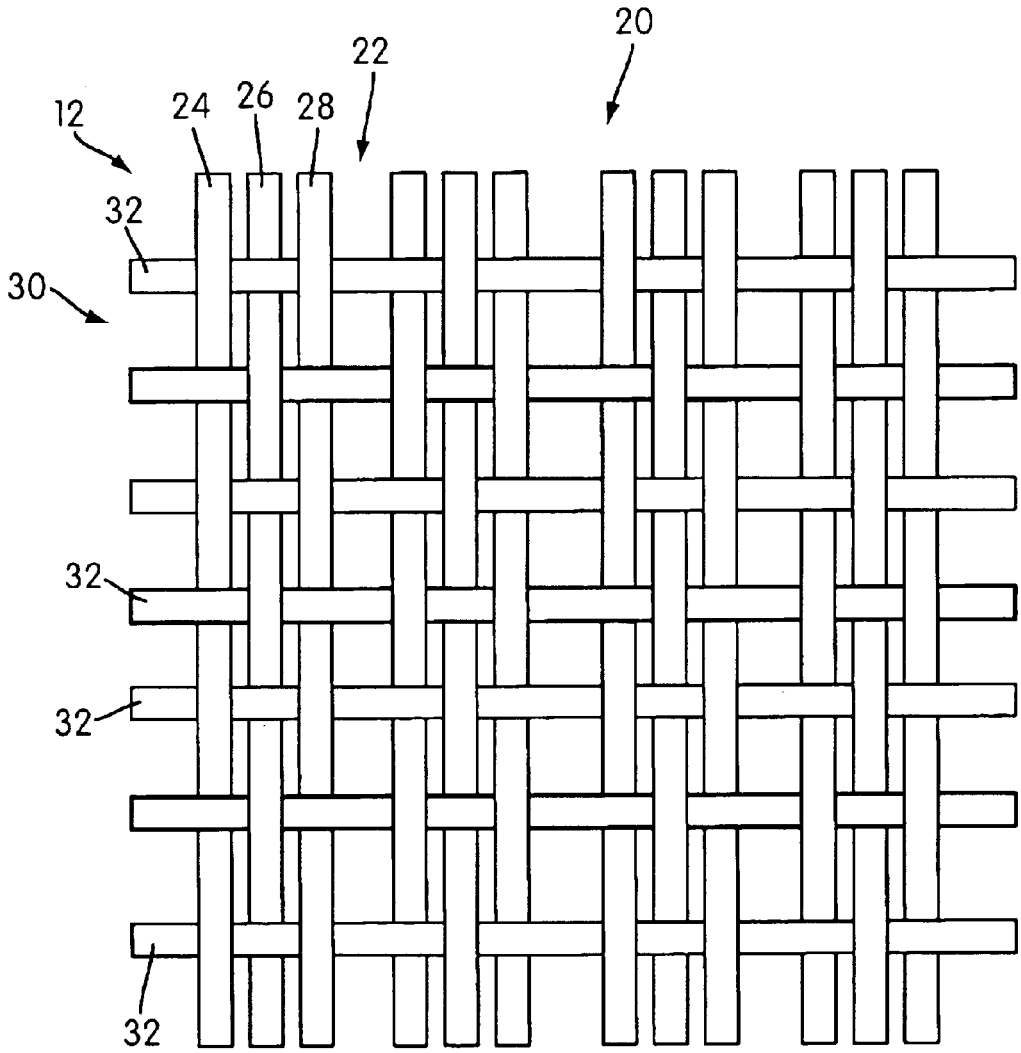
FIG. 2 is a top schematic view of the process belt shown in FIG. 1.

FIG. 2 shows a schematic top view of the belt 10. As illustrated, the body portion 12 comprises a first plurality set of elongated resilient filaments 20 including multiple groups 22 of elongated resilient filaments 24, 26, 28 oriented in a vertical (or first) direction. The vertical direction can be referred to as a machine direction and each elongated resilient filament 24, 26, 28 can be referred to as a warp filament, for example.

The body portion 12 can also include a second plurality of elongated resilient filaments 30 including at least one elongated resilient filament 32 oriented in a direction (a second direction) transverse to the first direction. The transverse direction can be referred to as a cross machine direction and each elongated resilient filament 32 can be referred to as a shute or weft filament, for example.

The first plurality of filaments 20 and the second plurality of filaments 30 can include equal or different numbers of individual filaments of equal or different diameters. For example, each inch of the belt 10 in length includes about 10–15 individual shute or weft filaments. More or less filaments can be provided per inch of the belt 10 depending on the paper process and/or paper process machine.

The individual filaments 24, 26, 28 and 32 are woven together, for example, using a weaving machine, to form the body portion 12. Alternatively, a single beam loom or a double beam loom can be used depending on the type of weave pattern chosen for the belt 10.

In the particular weave pattern shown in FIG. 2, for example, each group 22 includes three individual vertically extending filaments (two outer filaments 24, 28 and one central filament 26) woven around each horizontally extending filament 32. Other numbers of filaments and configurations are possible for each group and the number and configuration of each group may differ from group to group.

Specifically, in FIG. 2, the two outer filaments 24, 28 are woven to be on the opposite side of the filament 32 as the central filament 26. For example, in the group 22 (on the leftmost side of FIG. 2), the outer filaments 24, 28 are woven over the uppermost filament 32, while the central filament 26 is woven under the uppermost filament 32. End portions of each filament 18, 32, which extend horizontally in FIG. 2, can be bent along the length of the belt 10 to help position those filaments axially.

Each individual filament 24, 26, 28 and 32 can be made from carbon steel or other hardened metal, for example, into a solid filament. Alternatively, each individual filament 24, 26, 28 and 32 can include a plurality of filaments braided or twisted together to form a braided or twisted filament. Similarly, each elongated resilient coupling filament 18 can be made from carbon steel or other hardened metal, for example, into a solid or braided (twisted) filament.

Each filament 18, 24, 26, 28 and 32 can be coated, for example, to reduce corrosion and/or abrasion, through a coating process. The coating may be a low friction and contaminant resistant protective coating, for example, and may include brass or some other hardening (corrosion and abrasion resistant) material. The low friction and contaminant resistant protective coating can be applied by conventional coating techniques, such as dipping or continuously running the filaments through a bath. Alternatively, a batch dipping can be used.

Figure 5:
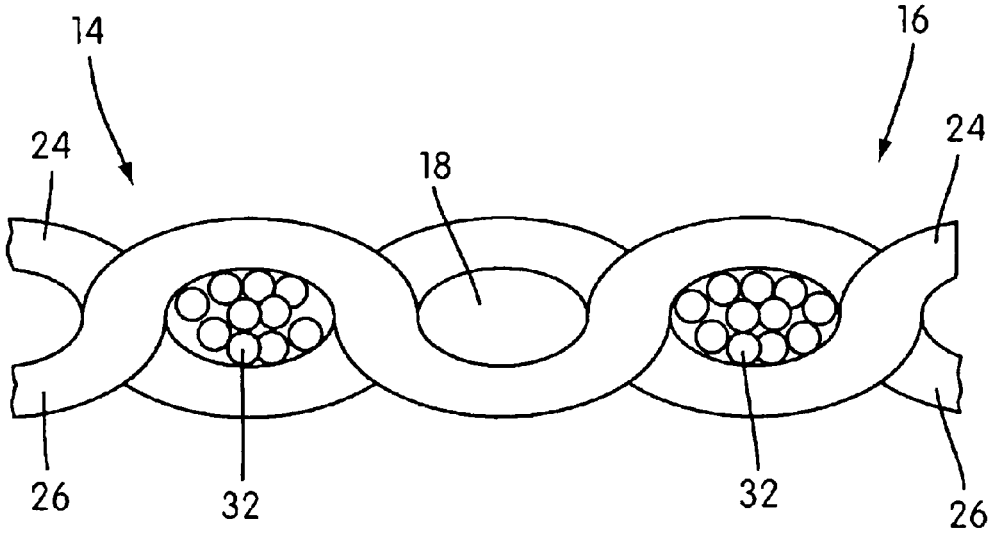
FIG. 5 is a cross-sectional view taken through the line 5—5 in FIG. 4.

FIGS. 3–5 show the end sections 14, 16 of the belt 10 coupled together with one or more coupling filaments 18 in greater detail. For example, each individual filament 24, 26, 28, 32 is illustrated as a braided (twisted) filament (only filaments 24, 26 and 32 are shown in FIG. 5) and each elongated resilient coupling filament 18 is illustrated as a solid filament. However, in an alternative embodiment not shown, the individual filaments 24, 26, 28, 32 can be a solid filament and each elongated resilient coupling filament 18 can be a braided (twisted) filament or any other combination thereof.

FIGS. 3 and 4 show each end section 14, 16 aligned with one another such that the coupling filaments 18 can be woven into the end sections 14, 16 to extend transversely across the vertically extending filaments 24, 26, 28. The end sections 14, 16 can be overlapped with respect to one another and one or more coupling filaments 18 are woven into the belt 10 to fixedly attach the end sections 14, 16 together. For example, the vertically extending filaments 24, 26, 28 of the end section 14 can be woven around horizontally extending filaments 32 of the end section 16 and vice versa.

The coupling filaments 18 form a continuous seam between the end sections 14, 16 so that the belt 10 can be continuous or endless. To help increase the strength of the continuous seam, about 24–72 coupling filaments can be used to form the continuous seam between the end sections 14, 16. Although only 4 coupling filaments are shown in FIG. 3, more or less coupling filaments can be used depending on the paper process.

Alternatively, in an embodiment not shown, the vertically extending filaments 24, 26, 28 of each end section 14, 16 can include a plurality of looped segments at end portions thereof. During manufacture of the belt 10, the end sections 14, 16 can be brought together to allow each looped segment of the vertically extending filaments 24, 26, 28 of end section 14 to align with a corresponding looped segment of the vertically extending filaments 24, 26, 28 of end section 16. The woven seam 17 can be formed by positioning one or more coupling filaments 18 through each of the looped segments.

Figure 6:
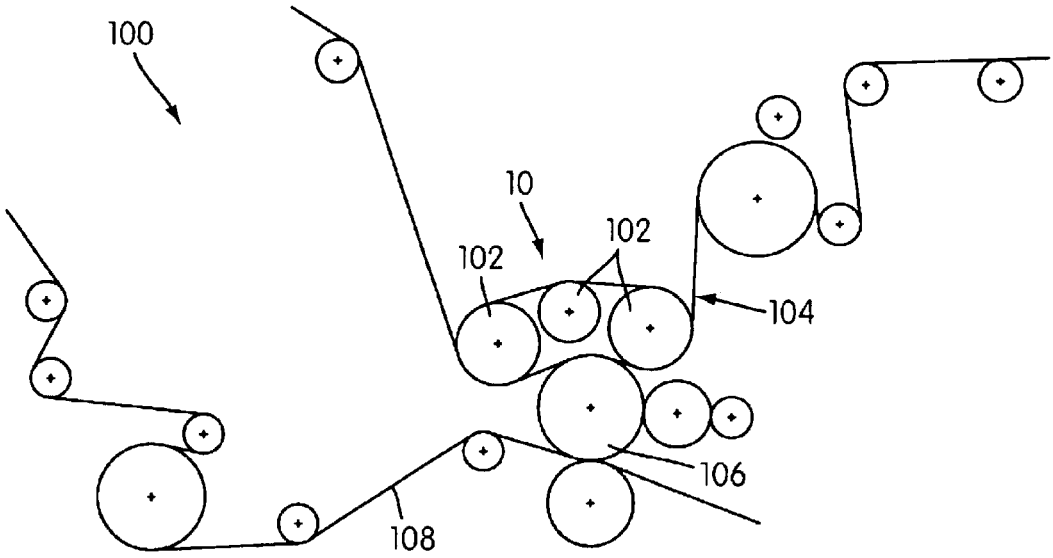
FIG. 6 is a schematic view of the process belt operatively engaged with a paper processing machine.

FIG. 6 shows the paper process belt 10 operatively engaged with a paper processing machine, generally indicated at 100, for example in a paper production facility. In general, the paper processing machine 100 includes a plurality of belts suspended from a plurality of rollers, some of which can be driven, to effect transport of paper material or stock from one point in the production facility to another.

As illustrated in this embodiment, the paper processing machine 100 is a corrugator configured to corrugate a paper stock. In this embodiment, the paper processing machine 100 can include the paper process belt 10 (which is shown in this embodiment as an upper corrugator belt) trained around a series of processing rolls 102 and a lower corrugator belt 104 which together pull a corrugated paper product (not shown) therethrough. The corrugated paper product can include a corrugated layer and an uncorrugated layer, which are to be joined to one another by a suitable adhesive in the paper processing machine 100. The corrugated and uncorrugated layers are brought together at one end of the machine 100 and are pulled across a hot roll 106 (or a series of hot plates) by the belts 10, 102 to dry and/or to cure the adhesive which bonds the corrugated and uncorrugated layers together. A belt 108 operatively associated with the hot roll 106 can carry the finished paper product to another part of the paper production facility.

The paper processing machine 100 is not limited to corrugator machines, but can be any paper processing machine capable of exerting high machine speeds or high stresses onto the belt and requiring a high number of operational cycles.

Figure 7:
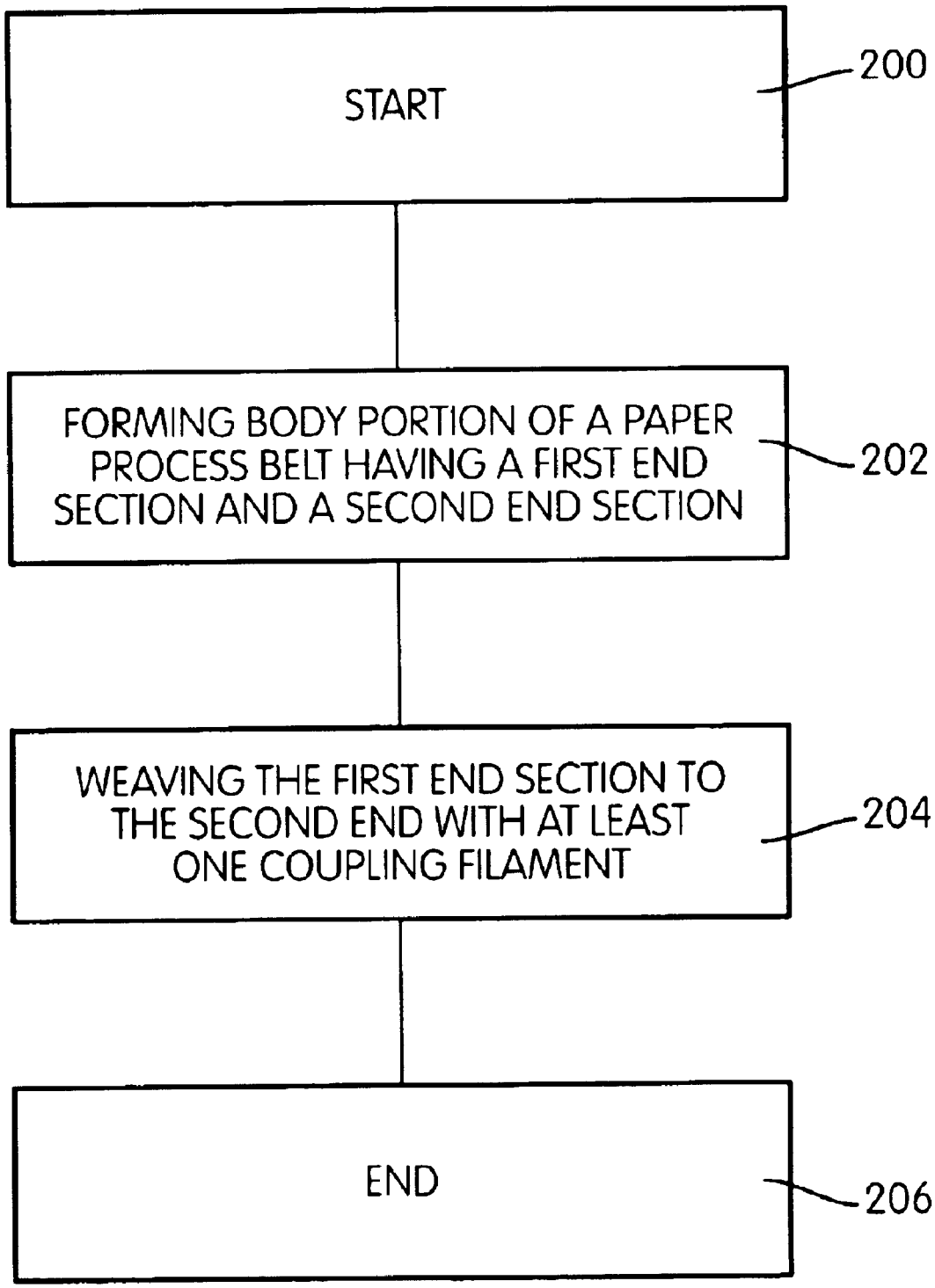
FIG. 7 is a flow chart illustrating a method in accordance with the principles of the invention.

FIG. 7 shows a flow chart illustrating a method of manufacturing a paper process belt for use in a paper manufacturing machine to process a paper stock. The method starts at 200. At 202, a body portion of the paper process belt is formed to have a first end section and a second end section. The body portion can be formed in many ways, one of which includes positioning a first plurality of elongated resilient filaments in a first direction and positioning a second plurality of elongated resilient filaments in a second direction transverse to the first direction. The first plurality of elongated resilient filaments and the second plurality of elongated resilient filaments can be woven together in a conventional manner, for example, manually or mechanically, in any known weave pattern. At 204, at least one coupling filament operatively connects the first end section to the second end section. For example, the coupling filament can be woven, for example, manually or mechanically, between the first end section and the second end section to form a continuous seam between the first end section, the second end section and the body portion. That way, the first end section, the second end section and the body portion are substantially continuous with respect to one another. At 206, the method ends.

While the present invention has been particularly shown and described with reference to the preferred embodiments thereof, it will be understood by those skilled in the art that various changes in form and details can be made therein without departing from the spirit and scope of the invention.

Thus, the foregoing embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A paper process belt for use in a paper manufacturing machine to process a paper stock, the belt comprising:

a body portion including a first plurality of elongated resilient filaments interwoven with a second plurality of elongated resilient filaments, the first plurality of elongated resilient filaments being oriented in a first direction and the second plurality of elongated resilient filaments being oriented in a second direction transverse to the first direction, one of the first plurality and the second plurality of elongated resilient filaments having a first end section and a second end section configured to be coupled to the first end section; and at least two elongated resilient coupling filaments separated from one another by at least one filament of the second plurality of elongated resilient filaments to operatively connect the first end section to the second end section so that the first end section, the second end section, and the body portion are substantially continuous with one another and configured to operatively engage the paper manufacturing machine.

2. The paper process belt of claim 1, wherein the first plurality of elongated resilient filaments includes at least one elongated resilient filament and the second plurality of elongated resilient filaments includes at least one elongated resilient filament.

3. The paper process belt of claim 2, wherein each elongated resilient filament includes a hardened metal.

4. The paper process belt of claim 3, wherein each elongated resilient filament includes a coating coated on the hardened metal.

5. The paper process belt of claim 4, wherein the hardened metal is carbon steel.

6. The paper process belt of claim 5, wherein the coating is a low friction and contaminant resistant protective coating.

7. The paper process belt of claim 5, wherein the coating is brass.

8. The paper process belt of claim 1, wherein the first end section at least partially overlaps the second end section and the at least two elongated resilient coupling filaments are weaved into the overlapping portion.

9. The paper process belt of claim 1, wherein the at least one elongated resilient coupling filament includes a hardened metal.

10. The paper process belt of claim 9, wherein the at least one elongated resilient coupling filament includes a coating coated on the hardened metal.

11. The paper process belt of claim 10, wherein the hardened metal is carbon steel.

12. The paper process belt of claim 10, wherein the coating is a low friction and contaminant resistant protective coating.

13. The paper process belt of claim 10, wherein the coating is brass.

14. A paper process belt for use in a paper manufacturing machine to process a paper stock, the belt comprising:

a first plurality of elongated resilient filaments oriented in a first direction a second plurality of elongated resilient filaments oriented in a second direction transverse to the first direction, one of the first plurality and the second plurality of elongated resilient filaments having a first end section and a second end section configured to be coupled to the first end section; and a woven seam including at least two elongated resilient coupling filaments operatively woven between the first end section and the second end section wherein the at least two elongated resilient coupling filaments are separated from one another by at least one filament of the second plurality of elongated resilient filaments.

15. A method of manufacturing a paper process belt for use in a paper manufacturing machine to process a paper stock, the method comprising:

forming a body portion of the paper process belt comprising a first plurality of elongated resilient filaments positioned in a first direction and interwoven with a second plurality of elongated resilient filaments positioned in a second direction that is transverse to the first direction, the body portion having a first end section and a second end section; and operatively engaging at least two coupling filament to the first end section and the second end section, such that the at least two elongated resilient coupling filaments are separated from one another by at least one filament of the second plurality of elongated resilient filaments so that the first end section, the second end section and the body portion are substantially continuous with respect to one another.

16. The method of claim 15, wherein the operatively engaging includes weaving at least one coupling filament into the first end section and the second end section.

17. The method of claim 16, wherein the weaving is manually performed.

18. A paper process belt for use in a paper manufacturing machine to process a paper stock, the belt comprising:

a plurality of elongated resilient filaments oriented in a substantially horizontal direction;

a plurality of vertically extending filaments woven between the plurality of horizontally extending filaments, each vertically extending filament having a first end section and a second end section configured to be coupled to the first end section; and a woven seam including at least two elongated resilient coupling filaments woven between the first end section and the second end section in a substantially horizontal direction wherein the at least two elongated resilient coupling filaments are separated from one another by at least one filament of the plurality of horizontally-oriented elongated resilient filaments.

* * * * *

UNITED STATES PATENT AND TRADEMARK OFFICE

CERTIFICATE OF CORRECTION

PATENT NO. : 7,005,038 B2
DATED : February 28, 2006
INVENTOR(S) : Michael Maguire It is certified that error appears in the above-identified patent and that said Letters Patent is hereby corrected as shown below:

Title page,
Item [73], Assignee, replace "National Wire Fabric, Inc., Star City, AK (US)" with -- National Wire Fabric, Inc., Star City, AR (US) --.

Signed and Sealed this

Twenty-third Day of May, 2006

JON W. DUDAS
*Director of the United States Patent and Trademark Office*